US006775970B2

(12) United States Patent
Fernandez

(10) Patent No.: US 6,775,970 B2
(45) Date of Patent: Aug. 17, 2004

(54) APPARATUS AND METHOD FOR MAKING A HYBRID CORD

(76) Inventor: Leobardo Paulino Fernandez, Carretera A Huimilpan No. 113-65 Conjunto Terranova III, Colonia (MX)

( * ) Notice: Subject to any disclaimer, the term of this patent is extended or adjusted under 35 U.S.C. 154(b) by 78 days.

(21) Appl. No.: 10/133,831

(22) Filed: Apr. 26, 2002

(65) Prior Publication Data

US 2003/0200739 A1 Oct. 30, 2003

(51) Int. Cl.[7] ..... D01H 7/00
(52) U.S. Cl. ..... 57/58.36; 57/58.52; 57/238
(58) Field of Search ..... 57/58.36, 58.38, 57/58.49, 58.52, 58.54, 58.55, 76, 77, 236, 237, 238, 240, 312

(56) References Cited

U.S. PATENT DOCUMENTS

| | | | | |
|---|---|---|---|---|
| 4,932,198 A | | 6/1990 | Eisenhauer et al. | |
| 5,855,704 A | * | 1/1999 | Reuter | 152/527 |
| 6,513,314 B2 | * | 2/2003 | Cook | 57/58.36 |

FOREIGN PATENT DOCUMENTS

| | | |
|---|---|---|
| DE | 1162239 | 1/1964 |
| EP | 0165188 | 12/1985 |

OTHER PUBLICATIONS www.thefreedictionary.com, "double helix" defined.*
www.webster.com. "parallel" defined.*
Weisser, Helmut and Czapay, Milan, "Twisting Systems for Tyre Cords", Technical Textile International, pp. 20–28, 1992.
Schellenberg, Hanz, "Cabling of Tire Cord, the Process for Now and the Future", Technical Technology, pp. 41–43, Jan. 1995.

* cited by examiner

*Primary Examiner*—John J. Calvert
*Assistant Examiner*—Shaun R Hurley
(74) *Attorney, Agent, or Firm*—Gregory N. Clements

(57) ABSTRACT

A process and apparatus are disclosed for making a hybrid cord which may be used. The process combines and twists at least three yarns together where one of the yarns is different. The different yarn maybe of a different size (denier), or made from a different polymer, or both. The hybrid cord may be used in tires, hoses, v-belts, and conveyor belts, for example. The apparatus is a modified direct cabler machine in which at least two yarns from a creel are combined and twisted about a third yarn issuing from a spindle pot. It is contemplated that the different yarn is preferably one of the yarns on the creel. Various tensioners are employed to tightly wrap or twist the yarns together (generally at a rate of from about 5–12 turns per linear inch of the yarn issuing from the spindle pot), and to wind the cord on a bobbin.

21 Claims, 1 Drawing Sheet

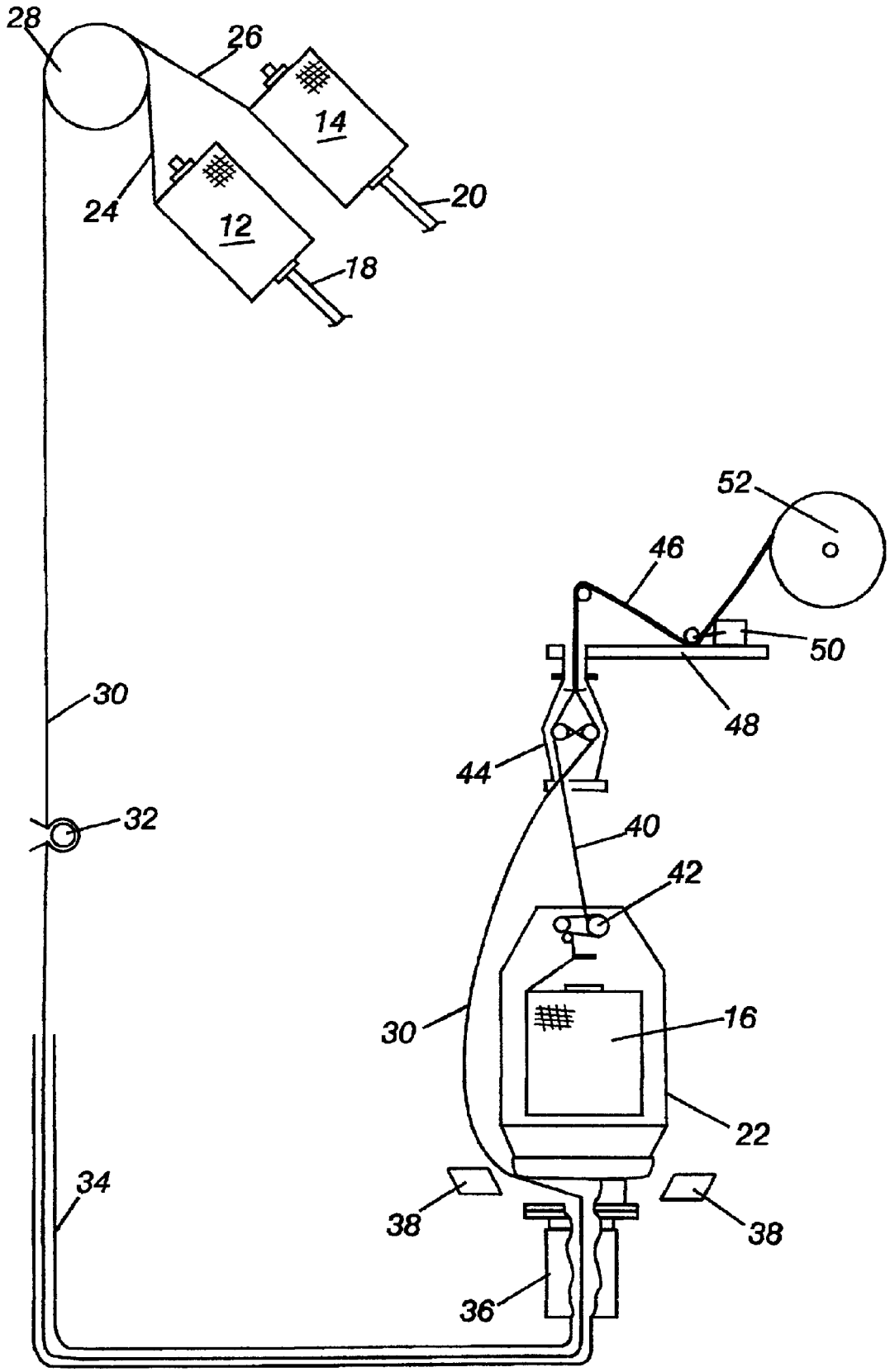
28
26
14
24
12
20
18
52
46
50
48
30
44
32
40
42
30
16
22
34
38
38
36

APPARATUS AND METHOD FOR MAKING A HYBRID CORD

BACKGROUND OF THE INVENTION

1) Field of the Invention

The present invention relates to apparatus for making cord structure for use in the reinforcement of pneumatic tires, hose, belts and other articles generally known as mechanical rubber goods. The invention also relates to a method for operating such equipment to form a hybrid yarn.

In particular, the invention describes a process for producing a cord from a supply of three yarns where one of the yarns is different. More particular, the process employs a modified cabling machine using two yarns on a reel and a third yarn from a spindle pot.

2) Prior Art

It is known in the art to have two and three twisted filament yarns twisted together to make a cord. However, at least 85% of the market consists of two twisted filament yarns twisted together to form a cord.

Twenty years ago ring twisters were the conventional equipment used first to twist the yarn filaments, and then to twist these twisted yarns (2 or 3) together to form a cord. The ring twisters had two operations, namely plying (twisting the yarns) and cabling (twisting the twisted yarns). Then in the early 1990's, commercially available cabling machines entered the market which twisted two yarn filaments together to form a cord in a single operation. Cabling machines became more popular because they eliminated one step from the ring twister process. Three filament cords are still made with ring twister apparatus.

An article by Helmut Weisser and Milan Czapay set forth in *Technical Textile International* and published in 1992, pages 20 to 28 discloses twisting systems for tire cords. The article discusses a classic ring twisting system and the new design apparatus labeled as "direct cabling". This article discloses yarns from a creel bobbin and a spindle pot bobbin which are twisted together to form a cord. This article concludes that the cabling process using direct cabling equipment "is not suitable for the production of 3 or multiply yarns."

An article titled "Cabling of Tire Cord, the Process for Now and the Future" by Hanz Schellenberg as published in *Textile Technology*, January, 1995, pages 41–43 also discloses the direct cabling process and states that these type cablers can cable nylons, polyester, rayon, and aramid.

U.S. Pat. No. 4,932,198 by Eisenhauer, et al. discloses a cabling machine having a creel, a spindle motor, a spindle pot containing a feed bobbin, and feeding the yarn upwardly through the spindle motor and around the spindle such that it can be twisted with yarn exiting from the spindle pot.

German Patent (Auslegeschrift) 1,162,239 having a patent date of Jan. 30, 1964 and assigned to Pirelli Tire Company discloses a direct cabling machine (and is one of the older disclosures for tire cord), and has a priority date based on an Italian patent of Jun. 6, 1957. This patent discloses a bobbin of yarn which is fed through the central part of a spindle such that it rotates to form a "balloon" around the spindle pot containing a second fiber and these two yarns are twisted together to form a tire cord.

European Patent Application 0,165,188 published on Dec. 18, 1985 and issued to Charbonnier also discloses a direct cabling machine but does not disclose a creel for the first yarn.

There exists a need in the market for a new and improved direct cabling system capable of twisting three yarn filaments together to form a cord substantially employing existing direct cabling equipment. In particular, there exists a need in the art to cable three yarn filaments together wherein one of the yarn filaments possesses a significantly smaller denier than the other two yarn filaments.

There also exists in the art a need for three yarn filaments twisted together to form a cable wherein one of the yarn filaments is of a different material.

SUMMARY OF THE INVENTION

In the broadest sense, the present invention comprises a process for producing a cord comprising providing a supply of at least three yarns wherein one of said yarns is different, and twisting all the yarns together to form a cord. The different yarn has a smaller denier and/or is a different polymer than the other yarns.

In the broadest sense, the present invention also comprises a process for producing a cord comprising providing at least two yarns tangled together, providing at least third yarn in a spindle pot, feeding at least two yarns through a rotating portion of the spindle and around the spindle pot to a twister, feeding the third yarn from the spindle pot to the twister, and twisting all the yarns together to form a cord. This process also contemplates that one of the at least two yarns tangled together has a smaller denier and/or is a different polymer than the other yarns.

In the broadest sense, the present invention also relates to an apparatus for producing a cord, comprising a creel containing at least two yarns, a spindle having a rotating portion and a stationary portion, the stationary portion at least containing a third yarn, the rotating portion rotating the yarns from the creel, and a twister for twisting the yarns from the creel and the third yarn to produce a cord.

It is an object of the present invention to produce a hybrid cord consisting of three yarn plies wherein one ply is of different material and/or has a substantially smaller denier than the remaining two plies.

BRIEF DESCRIPTION OF THE DRAWING

The drawing is to aid those skilled in the art in understanding the invention and is not meant to limit the scope of the invention in any manner beyond the scope of the claims.

The drawing shows the apparatus of the present invention and its operation describes a process for producing a three-filament hybrid cord made with substantially existing direct cabling equipment. Those skilled in the art recognize that the apparatus and process could be employed for producing more than a three-filament hybrid cord.

The FIGURE shows a schematic view of a direct cabling system.

DESCRIPTION OF THE PREFERRED EMBODIMENTS

The direct cabling system of the present invention is functional with many different types of yarn including fiberglass, aramid, nylon, polyester, rayon; including both spun yarn (as a monofilament) and yarn from staple fibers of fiberglass, aramid, nylon, polyester, and rayon; and natural fiber such as cotton and hemp; and mixtures of these such as cotton/polyester prepared from staple fibers. In particular, it is contemplated that the present invention would have bobbins containing the same denier yarn and a third bobbin containing a yarn of significantly smaller denier (preferably at least 50% the size of at least one of the other yarn deniers). For example, two of the yarns could be 1,000 denier polyester while the third yarn could be a 250 denier rayon yarn. The present invention also contemplates a hybrid cord comprising three different denier yarns such as a 1,000 denier polyester yarn, a 1,000 denier nylon yarn, and a 250 denier rayon yarn. While typical industrial yarn deniers range in size from 500–2,000 denier, it is contemplated that at least two and preferably more of the yarns of the present invention would have approximately the same denier, while at least one yarn is a different denier. It is also contemplated that the different yarn would have a denier of about 50% less than at least one, if not both, of the other yarn deniers employed.

While some of the conventional direct cabling yarn equipment states that the yarns are twisted together, other articles indicate that the outer yarn coming from the balloon wraps around the inner yarn coming from the spindle pot. The word "twisting" in the present invention is meant to cover both situations (twisted vs. wrapped).

The yarns employed may be from the same polymer or from different polymers, or the same denier or of different denier, or any combination of these. For example, a polyester yarn coming from the spindle pot could be a 1,500 denier, while a nylon and rayon yarn from the creel twist about the polyester yarn. In such a situation, the nylon yarn may have a denier more or less than that of the polyester, and the rayon would have a denier significantly less than the nylon denier. With the present invention it is contemplated that the smallest denier yarn and the second smallest denier yarn would be positioned side by side on a creel. The largest denier yarn would be in the spindle pot. While this preferred arrangement has been described, it is also possible that the largest and the smallest yarns could be on creels and the medium denier yarn could be in the spindle pot. The present invention also contemplates the smallest denier yarn issuing from the spindle pot. Thus, if yarns of different denier are used to make a hybrid cord, the yarns could be located on any position of the creel or in the spindle pot. Likewise, if yarns of different polymers are used to make hybrid cord, the yarns could be located in any position on the creel or in the spindle pot. Finally, the present invention is described in terms of three yarns making the hybrid yarn, however, more than three yarns could be employed with more creel positions, for example. Also the yarn in the spindle pot could already be a combination of different yarns, such that when combined with yarns from the creel a hybrid cord could be produced.

As shown in the drawing, there are three bobbins of yarn 12, 14 and 16. The bobbins 12 and 14 are on creel pins 18, 20 while bobbin 16 is mounted for rotation in a spindle pot 22. Yarns 24 and 26 are unraveled from bobbins 12 and 14, respectively, and traverse over a roller or pulley 28 which serves to tangle the yarns together such that they appear and perform as a single thread line 30. The single thread line 30 is maintained within a given tension range by tensioner 32. The yarn 30 is then introduced through the center of a spindle motor 36 which rotates the thread line 30 and slings it outwardly from spindle pot 22 so that during operation it appears to be in the shape of a balloon. Between the spindle motor 36 and the tensioner 32, as shown in the drawing, is an ejector tube for air threading the commingled yarn 30 to the spindle motor. While an ejector tube 34 is shown and is the preferred embodiment of the present invention, it could be replaced with other known apparatus such as rollers or pulleys which may be positioned, for example, where the thread line 30 changes directions. The spindle pot 22 does not rotate and in fact is held in stationary position by magnets 38 such that it does not rotate like yarn 30. The yarn 40 unwinding from the bobbin 16 in the spindle pot 22 likewise encounters a tensioner 42 to maintain the yarn 40 within a predetermined tension range. Yarn 30, along with yarn 40, proceed to the cord twister 44 which wraps the yarn 30 around and about the yarn 40 creating a twisted cord 46. The cord twister 44 is mounted for rotation on structure 48 and is rotated due to the rotation of the yarn 30 by the spindle motor 36. In other words, the yarn twister 44 rotates freely though it is mounted on the stationary structure 48. The cord 46 is kept in tension by a tension apparatus 50. The cord 46 is then wound on bobbin 52 by a motor, not shown. The function of the tensioner 50 is to keep the cord tension exiting the twister 44 in balance with the force of rotation of the bobbin 52 so that the cord is tensioned on the bobbin 52 in a consistent manner as it winds on the bobbin 52, and is not loose and does not fall off when the bobbin is vertically oriented.

The present invention produces a hybrid cord 46 which may have at least three different yarns. The tensioners 32, 42 and 50 may be any type of tensioner known in the art. Although the present invention shows two bobbins 12 and 14 on creel pins 18 and 20, it is within the scope of the present invention to have more than two sources of yarn, such as 3 bobbins on 3 creel pins.

In operation, yarns 24, 26 from bobbins 12, 14 respectively are partially wrapped about roller 28 such that they form one yarn 30, particularly after yarn 30 passes through tensioner 32. The rate at which the yarns 24, 26 are removed from the bobbins is determined by speed of the take up bobbin 52. Typical tire cord yarns have, for example, 5 to 12 turns per inch. Therefore, cylinder 52 rotates at a speed that permits the twister 44 to accomplish about 5 to 12 turns per inch of cord 40.

In operation, yarn 30 is tensioned by tensioner 32 before entering through the center of a spindle motor 36, where it forms a "balloon" which revolves around spindle pot 22. The size of the balloon is determined by the tensioner 32, the speed of rotation of the yarn caused by spindle motor 36, and the number of twists by the yarn twister 44. Yarn 30 is then combined with the yarn 40 exiting the spindle pot 22 from bobbin 16 and enters twister 44. Twister 44 twists the yarn 30 about yarn 40 to form a cord which is then wrapped around bobbin 52. The cord 46 that is wrapped on bobbin 52 may be employed in tire cord, as reinforcements for hoses and v-belts, and as reinforcements for conveyor belts for example. Hoses, belts, and conveyer belts are products frequently referred to as mechanical rubber goods.

Thus it is apparent that there has been provided, in accordance with the invention, a process and apparatus that fully satisfies the objects, aims, and advantages set forth above. While that invention has been described in conjunction with the specific embodiments thereof, it is evident that many alternatives, modifications, and variations will be apparent to those skilled in the art in light of the foregoing description. Accordingly, it is intended to embrace all such alternatives, modifications, and variation as fall within the spirit and broad scope of the claims.

What is claimed is:

1. A process for producing a cord, comprising: providing a supply of at least three yarns, wherein one of said yarns is different, tangling at least two yarns together to form a thread line, and then twisting said thread line together with at least a third yarn to form a cord, wherein two yarns are applied from a creel and the remaining yarn is supplied from a spindle pot.

2. The process of claim 1, wherein said different yarn is made of a different material.

3. The process of claim 1, wherein said yarns are selected from the class of fiberglass, cotton, hemp, olyester, nylon, aramide, rayon, and mixtures of these.

4. The process of claim 1, wherein said different yarn has a smaller denier than the other yarns.

5. The process of claim 1, wherein one of said creel yarns contains said different yarn.

6. The process of claim 1, wherein said yarns are twisted from about 5 to about 12 turns per inch of said cord length.

7. A process for producing a cord, comprising:

providing a supply of at least two yarns, providing a third yarn in a spindle pot, tangling said at least two yarns together form a thread line, feeding said thread line through a rotating portion of a spindle an around said spindle pot to a twister, feeding said third yarn from said spindle pot to said twister, and twisting said third yarn and said thread line together to form a cord.

8. The process for producing the cord of claim 7, comprising providing a tensioner between said supply of at least two yarns and said rotating portion of a spindle pot or keeping a constant tension on said thread line.

9. The process for producing the cord of claim 7, comprising providing a tensioner between aid spindle pot and said twister for keeping a constant tension on said yarn from said spindle pot.

10. The process of claim 7, wherein one of said yarns has a smaller denier than the other yarns.

11. The process of claim 7, wherein one of said yarns is made of a different material.

12. The process of claim 7, wherein said yarns are selected from the class of fiberglass, cotton, hemp, polyester, nylon, aramide, rayon, and mixtures of these.

13. The process of claim 7, wherein said yarns are twisted from about 5 to about 12 turns per inch of said cord length.

14. Apparatus for producing a cord, comprising: a creel containing at least two yarns, a tangling device for tangling said at least two yarns from said creel to form a thread line, a spindle having a rotating portion and a stationary portion, said stationary portion containing a bobbin of a third yarn, said rotating portion rotating said thread, and a twister for twisting said thread line together with said third yarn from said bobbin to produce said cord.

15. The apparatus of claim 14, further including a tensioner positioned between said bobbin and said twister for tensioning said third yarn.

16. The apparatus of claim 14, further including a tensioner positioned between said creel and said rotating portion of said spindle to tension said thread line.

17. The apparatus of claim 14, further including a take-up roll positioned after said twister to take-up said cord.

18. The apparatus of claim 14 wherein one of said yarns on said creel is a different type yarn.

19. The apparatus of claim 18, wherein said different type yarn is a lower denier yarn than said other yarns.

20. The apparatus of claim 18, wherein said different type yarn is made from a different material.

21. The apparatus of claim 14, wherein said twister rotates at from about 5 to about 12 turns per inch of said third yarn.

* * * * *